US010155383B2

(12) United States Patent
Elliot

(10) Patent No.: US 10,155,383 B2
(45) Date of Patent: Dec. 18, 2018

(54) MULTI-PART PRINTHEAD ASSEMBLY

(71) Applicant: HEWLETT-PACKARD DEVELOPMENT COMPANY, L.P., Houston, TX (US)

(72) Inventor: Joseph R. Elliot, Corvallis, OR (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/427,222

(22) Filed: Feb. 8, 2017

(65) Prior Publication Data

US 2017/0144439 A1 May 25, 2017

Related U.S. Application Data

(63) Continuation of application No. 14/570,947, filed on Dec. 15, 2014, now Pat. No. 9,604,459.

(51) Int. Cl.

| | |
|---|---|
| ***B41J 2/14*** | (2006.01) |
| ***B41J 2/145*** | (2006.01) |
| ***B41J 2/15*** | (2006.01) |
| ***B41J 2/155*** | (2006.01) |
| ***B41J 2/175*** | (2006.01) |

(52) U.S. Cl.

CPC ..... *B41J 2/1433* (2013.01); *B41J 2/145* (2013.01); *B41J 2/15* (2013.01); *B41J 2/155* (2013.01); *B41J 2/175* (2013.01); *B41J 2002/14362* (2013.01); *B41J 2002/14419* (2013.01); *B41J 2202/19* (2013.01); *B41J 2202/20* (2013.01)

(58) Field of Classification Search

CPC ... B41J 2/1433; B41J 2/145; B41J 2/15; B41J 2/155; B41J 2/175

See application file for complete search history.

(56) References Cited

U.S. PATENT DOCUMENTS

| | | | | |
|---|---|---|---|---|
| 4,612,554 | A | 9/1986 | Poleshuk | |
| 4,829,324 | A | 5/1989 | Drake et al. | |
| 5,041,190 | A | 8/1991 | Drake et al. | |
| 5,160,403 | A | 11/1992 | Fisher et al. | |
| 5,218,754 | A | 6/1993 | Rangappan | |
| 5,221,397 | A | 6/1993 | Nystrom | |
| 5,755,024 | A | 5/1998 | Drake et al. | |
| 6,339,881 | B1 | 1/2002 | Fisher et al. | |
| 6,799,828 | B2 * | 10/2004 | Silverbrook | B41J 2/14427 347/25 |
| 8,967,769 | B1 * | 3/2015 | Dowell | B41J 2/155 347/40 |

(Continued)

FOREIGN PATENT DOCUMENTS

WO WO-2013112168 A1 8/2013

*Primary Examiner* — Jason S Uhlenhake

(74) *Attorney, Agent, or Firm* — HP Inc Patent Department

(57) ABSTRACT

In an example, a printhead assembly includes a plurality of printheads and a printing fluid flow structure including an upper body part comprising a number of flow regulators to regulate the flow of printing fluid through the printing fluid flow structure; a lower body part comprising a number of printing fluid passages to carry the printing fluid to the plurality of printheads; and a manifold placed between the upper body and lower body to carry the printing fluid from the upper body part to the lower body part.

13 Claims, 14 Drawing Sheets

(56) References Cited

U.S. PATENT DOCUMENTS

| | | | | |
|---|---|---|---|---|
| 2005/0095049 | A1* | 5/2005 | Yoshida | B41J 3/4071 400/223 |
| 2006/0256159 | A1* | 11/2006 | Owaki | B41J 2/14233 347/54 |
| 2009/0195578 | A1* | 8/2009 | Jung | B41J 2/155 347/12 |
| 2012/0019593 | A1 | 1/2012 | Scheffelin | |
| 2012/0182349 | A1 | 7/2012 | Hagiwara | |
| 2014/0285576 | A1* | 9/2014 | Rivas | B41J 2/155 347/41 |
| 2015/0062245 | A1 | 3/2015 | Dowell | |
| 2015/0367638 | A1* | 12/2015 | Hanagami | B41J 2/1433 347/44 |

* cited by examiner

MULTI-PART PRINTHEAD ASSEMBLY

BACKGROUND

In some inkjet printers, a substrate wide printhead assembly or group of printhead assemblies commonly referred to as a "print bar" is used to print on paper or other print substrates moving past the print bar. Print bars include a datuming system that allows the printhead assemblies to be properly positioned in the printer.

DRAWINGS

The same part numbers are used to designate the same or similar parts throughout the figures.

DESCRIPTION

Figure 1A:
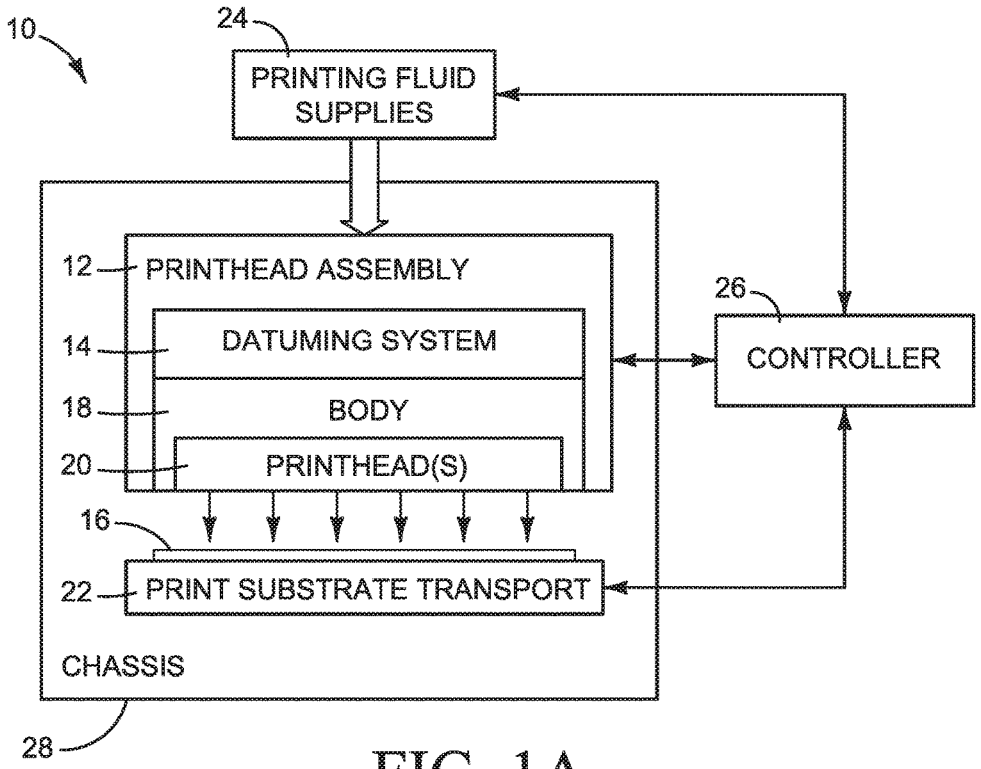
FIG. 1A is a block diagram illustrating an inkjet printer implementing one example of a new printhead assembly.

Dispensing ink and other printing fluids accurately onto a print substrate depends on precisely controlling the position of a print bar, print bar module or other inkjet type printhead assembly in the printer. The position of the printhead assembly is controlled through a set of datum points on the printhead assembly that contact mating datum points on the printer chassis. It is usually desirable to maximize the distance between datum points to improve the precision with which the position of the printhead assembly can be controlled. Maximizing the distance between datum points in a multiple part printhead assembly, however, may require locating the datum points on different parts of the printhead assembly.

For example, in the printhead assembly disclosed in international patent application no. PCT/US2012/022818 titled PRINTHEAD ASSEMBLY DATUM and filed Jan. 27, 2012, the desired distance between datum points is achieved by locating one of the datum points on an upper body part away from the other datum points located on a lower body part. A fluid flow manifold is clamped between the upper and lower body parts to carry printing fluid from flow regulators in the upper body part to flow passages in the lower body that carry printing fluid to the individual printheads. Since the upper and lower body parts are important structural members bearing datum points, they are usually made of aluminum or another suitably stiff, dimensionally stable material, while the manifold is usually made of a less expensive material like molded plastic. It has been discovered through testing that the position of the upper body part relative to the lower body part in this metal-plastic-metal sandwich is not always stable under environmental and operational stresses. Such instability can cause the unwanted displacement of the datum point on the upper body part relative to datum points on the lower body part.

A new printhead assembly body structure has been developed to help stabilize the datum points for better position control by removing the plastic manifold from the joint between the metal upper and lower body parts. The upper and lower body parts are joined together directly (or indirectly through metal spacers) so that there is no intervening plastic or other disparate material between the two metal body parts. The manifold is still located between the upper and lower body parts, but it is no longer part of the joint between those parts, thus preserving the ability to use less expensive materials for the manifold.

Although the new structure was developed for a printhead assembly with a plastic manifold sandwiched between metal body parts, other implementations are possible. More generally, for example, a printhead assembly includes first and second body parts each bearing one or more of the datum points used to position the assembly in the printer. The two body parts are joined to one another with no intervening body parts, to help minimize the risk that one (or more) of the datum points moves under environmental and operational stresses. These and other examples shown in the figures and described herein illustrate but do not limit the claimed subject matter, which is defined in the Claims following this Description.

As used in this document, a "datum" means something used as a basis for positioning, measuring or calculating; a "printhead" means that part of an inkjet printer or other inkjet type dispenser for dispensing fluid from one or more openings, for example as drops or streams; a "printhead assembly" means an assembly with one or more printheads and may include, for example, flow structures to carry printing fluid to the printhead(s); and a "print bar" means a structure or device holding an arrangement of one or more printheads or printhead assemblies that remains stationary during printing. "printhead", "printhead assembly", and "print bar" are not limited to printing with ink but also include inkjet type dispensing of other fluids and/or for uses other than printing. "Horizontal" and "vertical" and other terms of orientation or direction are determined with reference to the usual orientation of a printhead assembly when installed in a printer for printing in which the printheads face downward.

Figure 1B:
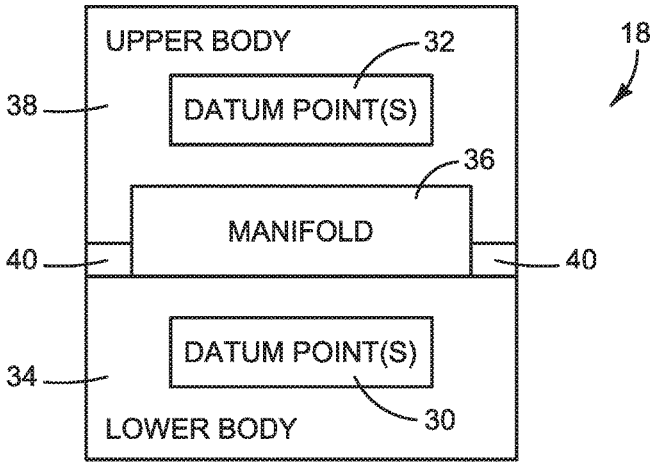
FIG. 1B is a block diagram illustrating one example of a printhead assembly body such as might be used in the printhead assembly shown in FIG. 1A.

FIG. 1A is a block diagram illustrating an inkjet printer 10 implementing one example of a printhead assembly 12 with a datuming system 14. FIG. 1B is a block diagram illustrating one example of a printhead assembly body such as might be used in the printhead assembly shown in FIG. 1A. Referring to FIGS. 1A and 1B, printer 10 includes a printhead assembly 12 and a datuming system 14 to help position the printhead assembly for printing on a sheet or continuous web of paper or other print substrate 16. A body 18 supports an arrangement of one or more printheads 20 for dispensing ink or other printing fluid on to print substrate 16. Printer 10 also includes a print substrate transport 22 to move substrate 16, printing fluid supplies 24 to supply printing fluid to printhead assembly 12, and a controller 26. Controller 26 represents the programming, processor(s) and associated memories, and the electronic circuitry and components needed to control the operative elements of printer 10. A chassis 28 supports printhead assembly 12 and other elements of printer 10.

Datuming system 14 includes two sets of one or more datum points 30, 32 each formed on a different part of body 18. In the example shown in FIG. 1B, body 18 includes a first, lower body part 34, a manifold 36 and a second, upper body part 38. Datum point(s) 30 are formed on lower body 34. Datum point(s) 32 are formed on upper body 38. Upper body part 38 may house, for example, flow regulators to regulate the flow of printing fluid to printheads 20. Lower body part 34 may house, for example, a usually complex array of flow passages to distribute printing fluid to individual printheads 20. Manifold 36 carries printing fluid from flow regulators in upper body 38 to flow passages in lower body 34. Lower body 34 and upper body 38 are joined together at a joint 40 (or multiple joints 40) with no intervening body parts. Examples for joining body parts 34 and 38 are described below with reference to FIGS. 2-16.

Figure 2:
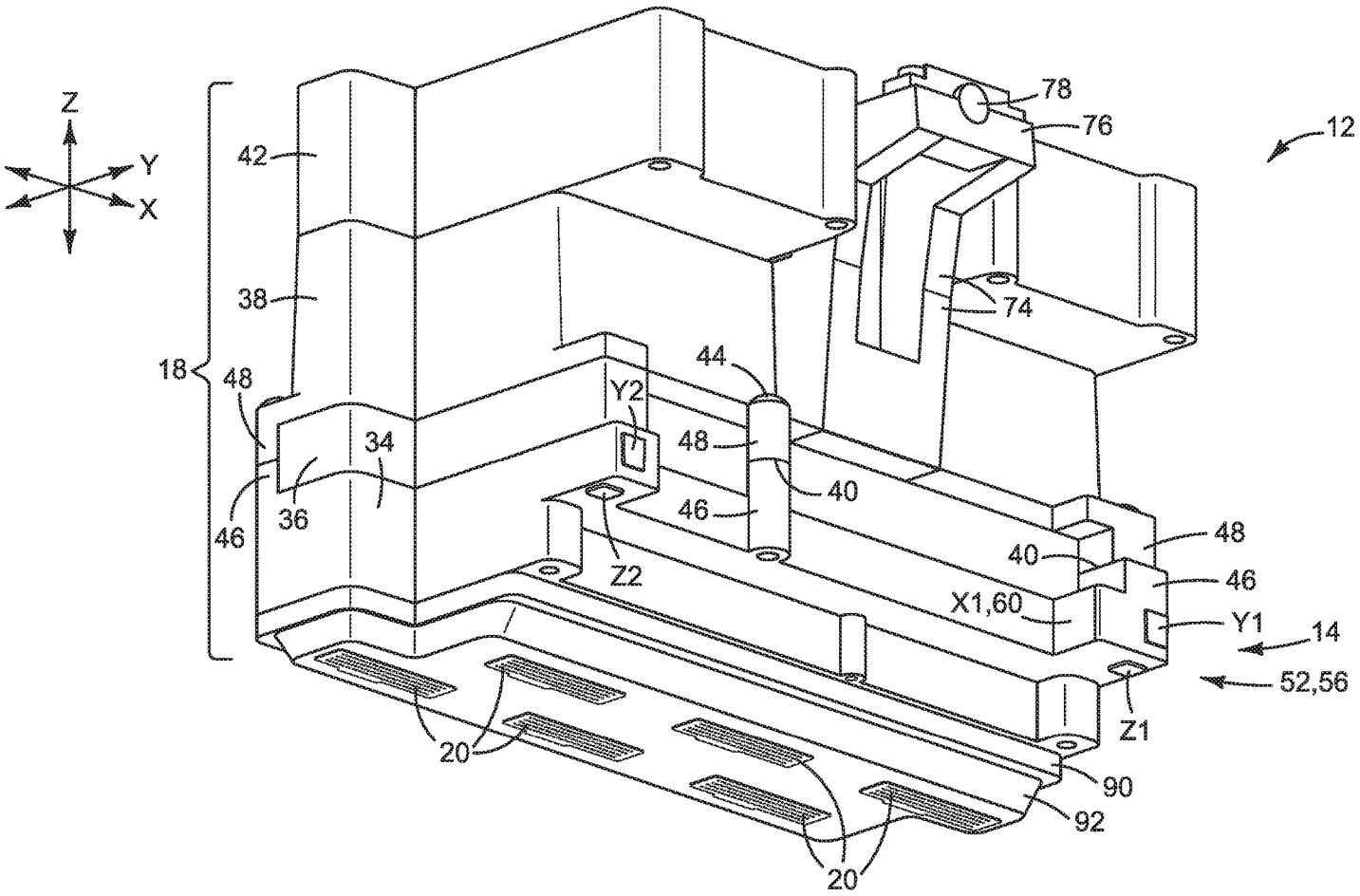
FIGS. 2-4 illustrate one example of a printhead assembly such as might be used in the printer shown in FIG. 1.
Figure 3:
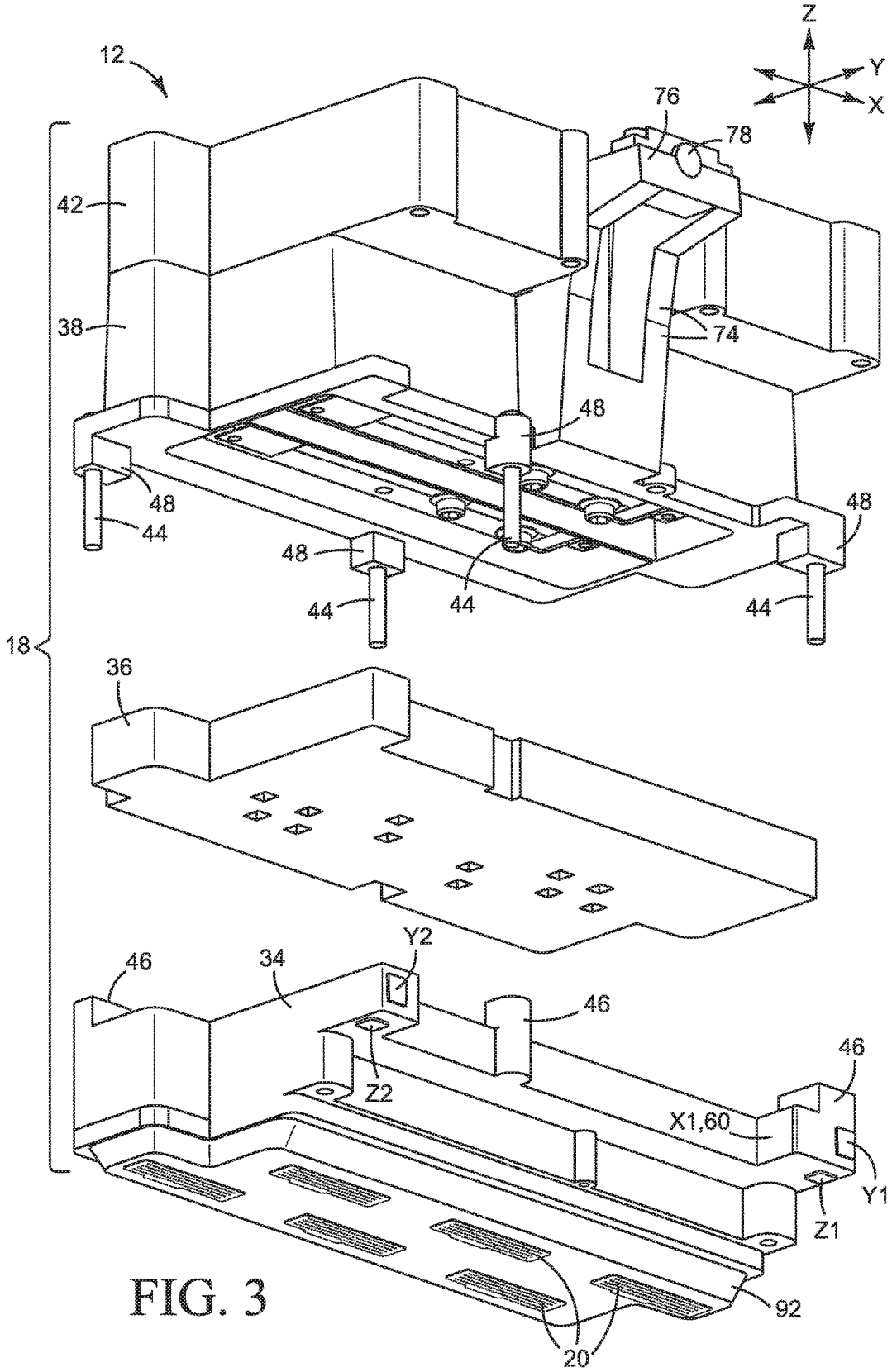
Figure 4:
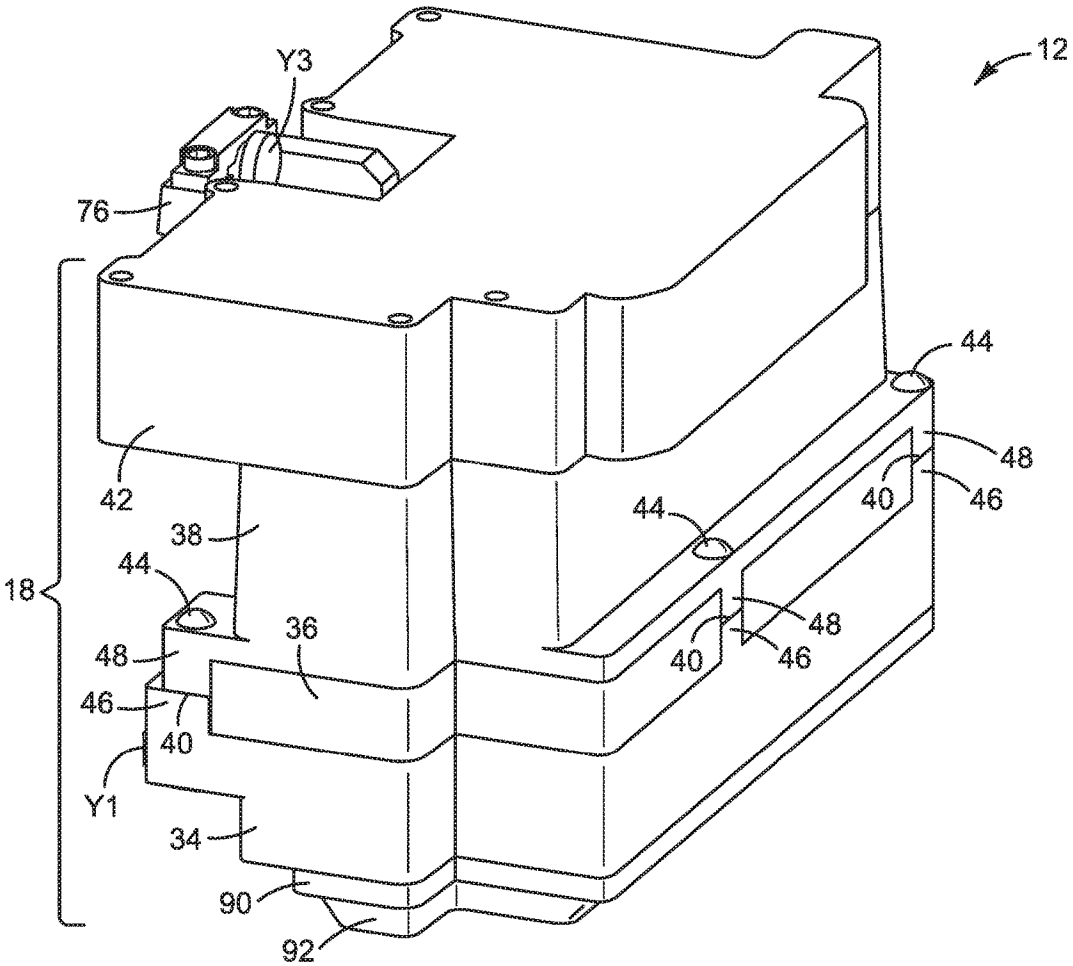
Figure 4:
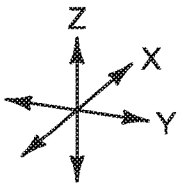
Figure 5:
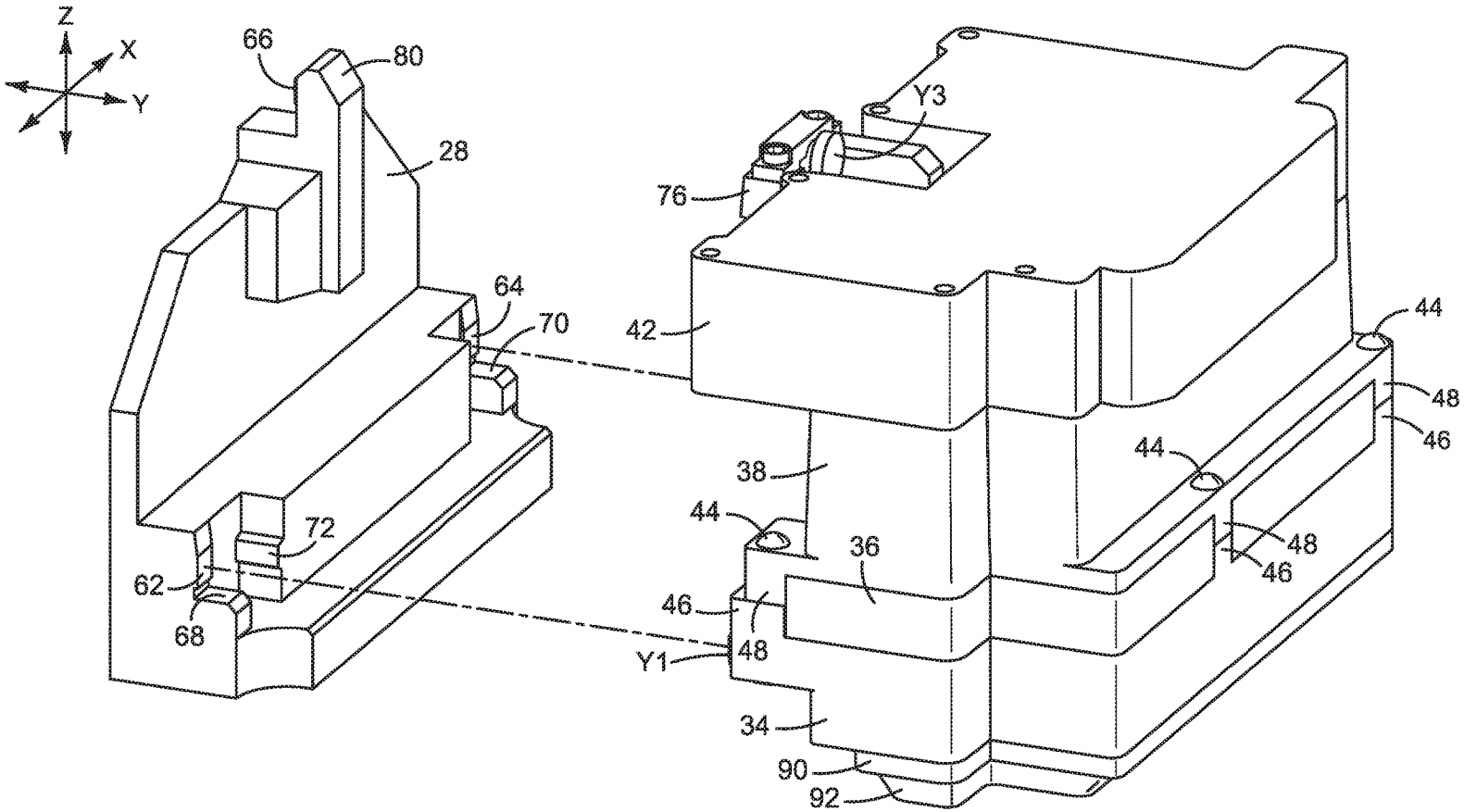
FIGS. 5-8 illustrate one example of mounting the printhead assembly of FIGS. 2-4 into a printer chassis.
Figure 6:
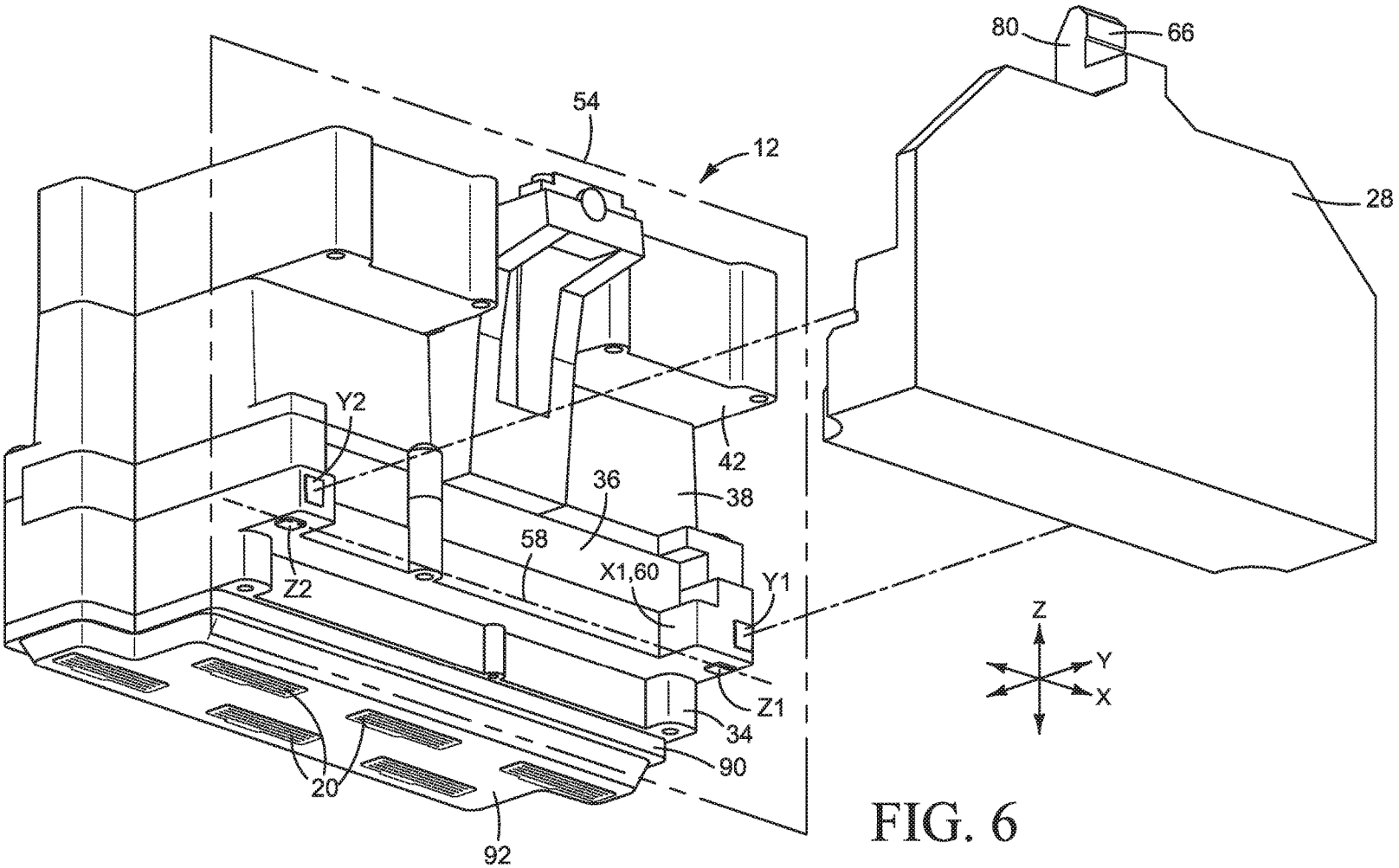

FIGS. 2-4 illustrate a printhead assembly 12 with a datuming system 14 and body 18 such as might be used in the printer shown in FIG. 1. A printhead assembly 12 shown in FIGS. 2-4 may be implemented, for example, as a print bar that itself spans substantially the full width of a print substrate, one of a group of print bar modules that together span a print substrate, or a carriage mounted scanning type ink pen. Referring to FIGS. 2-4, printhead assembly body 18 includes a lower body 34 that supports multiple printheads 20 and houses fluid flow parts to carry printing fluid to printheads 20. Body 18 also includes an upper body 38 housing flow regulators to control the flow of printing fluid to printheads 20, a manifold 36 to carry printing fluid from upper body 38 to lower body 34, and a cover 42.

Other suitable configurations for a printhead assembly 12 are possible. For example, fewer or more body parts may be used and the size, shape and function of each part may be different from those shown. Presently it is difficult to cost effectively fabricate the complex fluid flow paths and containment and support structures in a single part for some of the wider printhead assemblies used in substrate wide print bars. Thus, for wider printhead assemblies these elements are formed in multiple parts glued, welded, screwed or otherwise fastened to one another, for example as shown in FIGS. 2-4. Also, an assembly of multiple parts facilitates the selective use of metal and other higher cost materials in combination with plastic and other lower cost materials. For example, where, as here, the datum points are located on body parts 34 and 38, those parts may be metal to provide a rigid framework for accurately mounting other parts and for datuming the printhead assembly. The fluid flow structures of manifold 36, by contrast, may be plastic parts supported by metal parts 34 and 38.

Continuing to refer to FIGS. 2-4, lower body 34 and upper body 38 are joined together directly at joints 40. In the example shown, screws or other mechanical fasteners 44 are used to join body parts 34 and 38. Other suitable joining techniques or devices may be used. For example, it may be desirable in some implementations to weld together body parts 34 and 38 at joints 40. Also, joining body parts 34 and 38 "directly" in this context means the parts are joined in such a way that they function structurally like a single part, and does not preclude the use of a thin gasket or other insubstantial intermediary. In one example, lower body 34 and upper body 38 are both made of aluminum. Although aluminum will be desirable for many printing implementations due to its high strength, rigidity and light weight, other dimensionally stable materials could be used. Also, while it usually will be desirable to form both lower body 34 and upper body 38 from the same material, different materials with the same or similar mechanical properties may be used to help stabilize the datum points. In the example shown in FIGS. 2-4, joints 40 are formed at the interface of bosses 46 on lower body 34 and bosses 48 on upper body 38. Each boss 46, 48 spans roughly half the height of manifold 36. The size, number and location of bosses 46, 48 and thus joints 40 are selected to provide the desired clamping forces to securely fasten the bodies together. In the example shown in FIGS. 2-4, four joints 40 at locations staggered across the front and back sides of bodies 34, 38 are used. Other suitable configurations for the shape, number and location of joints 40 are possible, including bosses formed entirely on one or the other body part FIGS. 5-8 illustrate one example for mounting printhead assembly 12 into a printer chassis 28. Printer chassis 28 in FIGS. 5-8 represents generally only that part of a printer's chassis that supports printhead assembly 12. The overall printer chassis is a typically complex structure and may include multiple parts that support multiple components and assemblies within the printer, including a printhead assembly 12 or group of printhead assemblies 12. Six datum points may be used to correctly position and constrain printhead assembly 12 in all six degrees of freedom of motion. Three datum points establish a plane as the primary datum, two datum points establish a line as the secondary datum, and one datum point establishes a point as the tertiary datum. In the example shown in FIGS. 2-8, datuming system 14 includes a primary datum 52 with datum points Y1, Y2, and Y3 establishing a vertical plane 54, a secondary datum 56 with datum points Z1 and Z2 establishing a horizontal line 58, and a tertiary datum 60 with datum point X1.

Datum points X1, Y1-Y3, and Z1-Z3 are physically embodied on printhead assembly 12 as small reference surfaces and, accordingly, are referred to herein synonymously as datum points and reference surfaces. As shown in FIGS. 5-8, primary datum reference surfaces Y1, Y2, Y3 on printhead assembly 12 abut mating surfaces 62, 64, 66 on printer chassis 28. Secondary datum reference surfaces Z1, Z2 abut mating surfaces 68, 70 on chassis 28 and printer tertiary datum reference surface X1 abuts a mating surface 72 on printer chassis 28. It is usually desirable to maximize the distance between datum points to improve the precision with which printhead assembly 12 can be accurately positioned in chassis 28. Lower body 34 is relatively short in the Z direction and long in the X and Y directions. While lower body 34 may be long enough in the X and Y directions for good datuming, it may not be long enough in the Z direction. Thus, the third primary datum point Y3 may be placed on upper body part 38 away from lower body 34.

Figure 8:
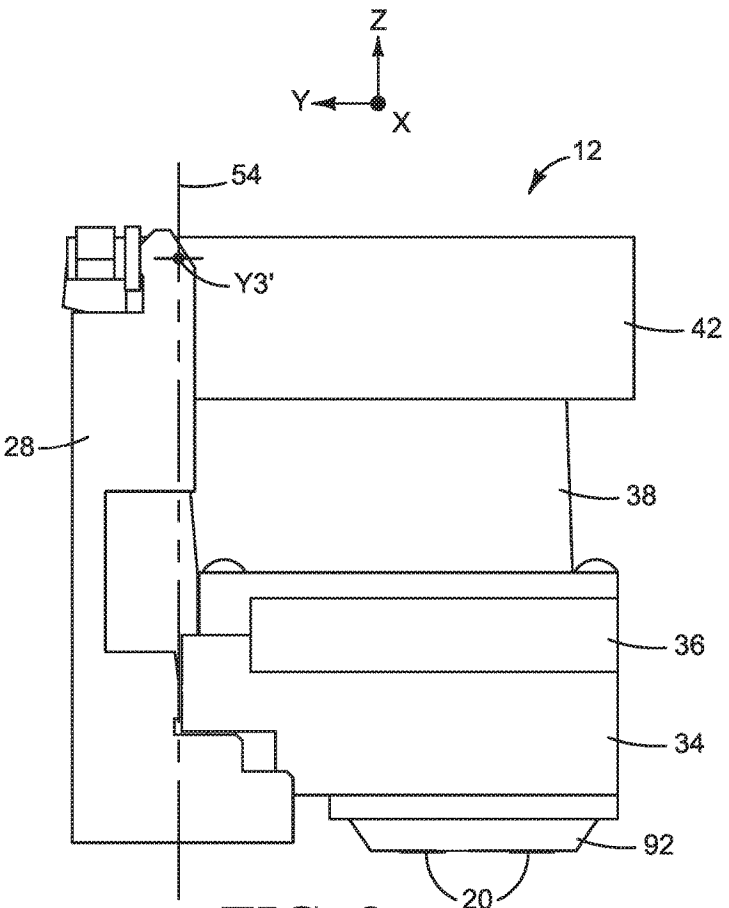
Figure 7:
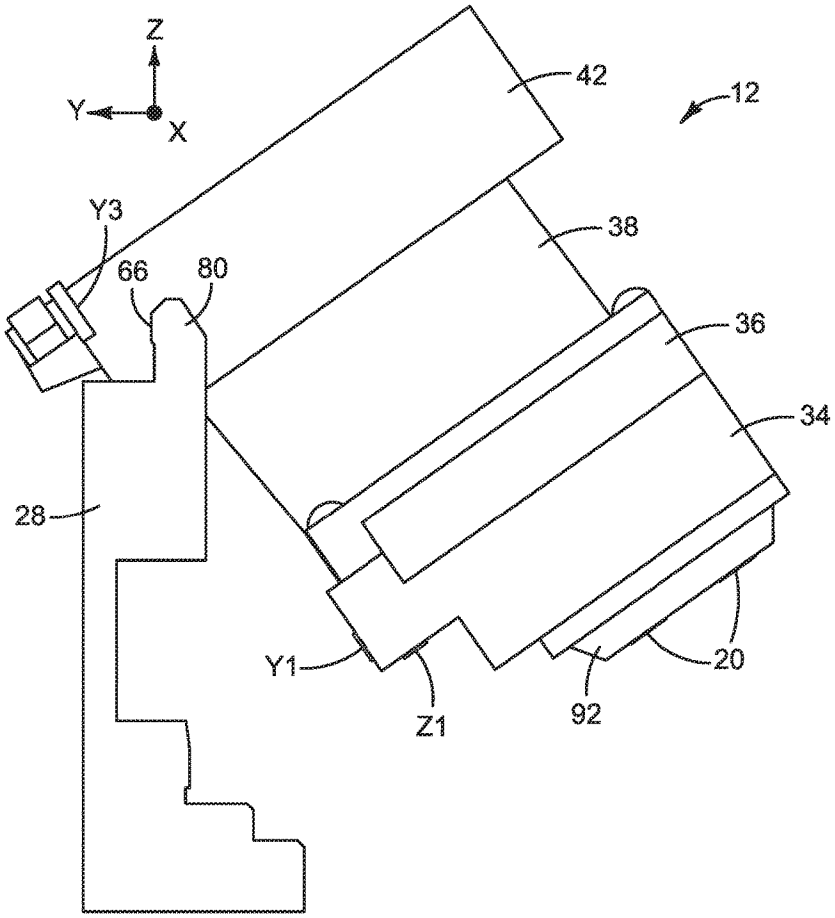

In the example shown in FIGS. 2-8, upper body 38 includes an L shaped neck 74 that ends in a hook 76. Datum point Y3 is formed on the face of a pin 78 clamped to hook 76. The mating reference surface 66 is formed on the backside of a post 80 on chassis 28 (facing away from reference surfaces 62, 64). This configuration for datuming system 14 allows a "cantilever" mounting structure shown in FIG. 8, for a smaller print zone and efficient substrate path through the print zone. Printhead assembly 12 is mounted to chassis 28 by hooking neck 74 over chassis post 80 as shown in FIG. 7, and rotating printhead assembly 12 into contact with the chassis datums as shown in FIG. 8. This hooked configuration for mounting printhead assembly 12 utilizes the torque generated by the weight of printhead assembly 12 hanging from chassis 28 to help datum points Y1-Y3, Z1, Z2, and X1 into contact with the corresponding chassis reference surfaces 62, 64, 66.

When mounted in a printer, primary datum 52 (Y1, Y2, Y3) establishes the correct translational position of printhead assembly 12 in the Y direction and the correct rotational position of printhead assembly 12 about the X and Z axes. A datum that constrains translation in the Y direction is commonly referred to as a "Y" datum. Printer secondary datum 56 (Z1, Z2) establishes the correct translational position of printhead assembly 12 in the Z direction and the correct rotational position of printhead assembly 12 about the Y axis. A datum that constrains translation in the Z direction is commonly referred to as a "Z" datum. Printer tertiary datum 60 (X1) establishes the correct translational position of printhead assembly 12 in the X direction. A datum that constrains translation in the X direction is commonly referred to as an "X" datum. In datuming system 14, therefore, primary datum 52 is a Y datum, secondary datum 56 is a Z datum, and tertiary datum 60 is an X datum.

In the example shown in FIGS. 2-8, printer primary datum points Y1, Y2, Y3 establish a vertical, Y datum plane 54 but not all three datum points Y1, Y2, Y3 lie in the same vertical plane. As best seen in FIG. 7, datum point Y3 is offset from points Y1 and Y2 in the Y direction. Thus, in this example, a projection Y3' of datum point Y3 lies in the same plane 54 as datum points Y1 and Y2. That is to say, datum plane 54 is defined by the three points Y1, Y2, Y3'. It is not necessary that all of the physical datum points lie in the same plane or along the same line to establish the corresponding datum. Rather, the physical datum points that establish a datum plane or a datum line may be offset from the other physical datum points and a projection used to define the plane or line with the desired position and/or orientation, as long as the projection has a fixed relationship to the corresponding physical datum point.

Figure 9:
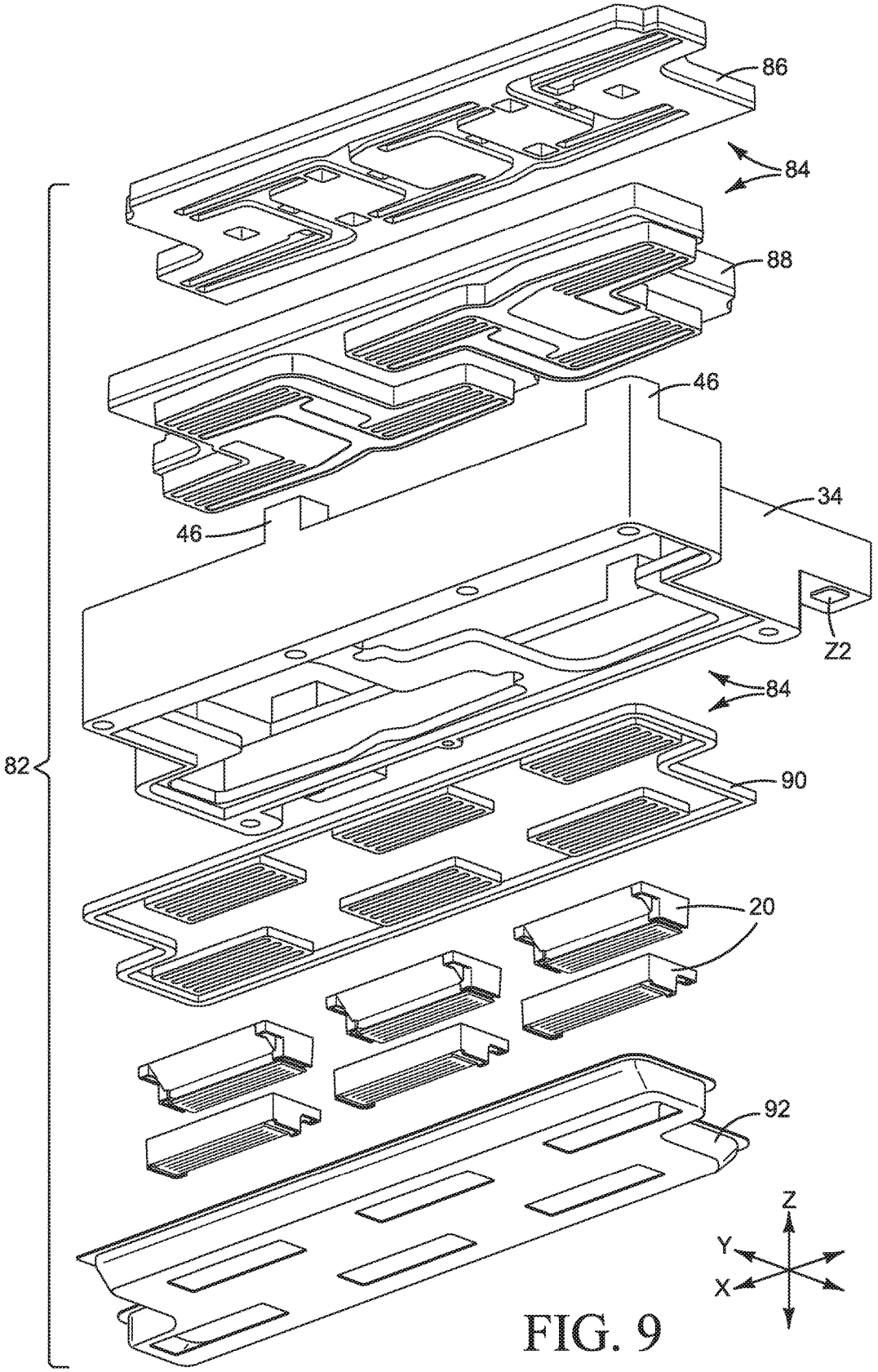
FIG. 9 illustrates one example of a lower subassembly in the printhead assembly of FIGS. 2-4.
Figure 10:
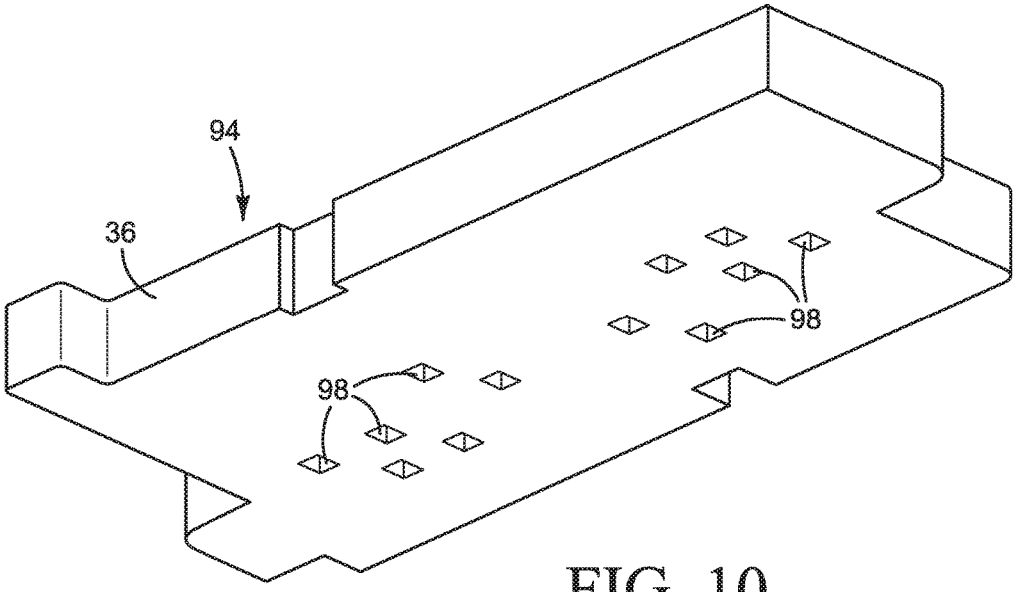
FIGS. 10 and 11 illustrate one example of a middle subassembly in the printhead assembly of FIGS. 2-4.

FIG. 9 is an exploded view illustrating one example of a lower subassembly 82 in printhead assembly 12. Referring to FIG. 9, lower subassembly 82 includes a multi-part flow structure 84 supported by lower body 34. In the example shown, flow structure 84 includes a top plate 86 and a middle plate 88 housed inside body 34 and a bottom plate 90 supported along the bottom of body 34. Printheads 20 are attached to bottom plate 90. Assembly 82 also includes a shroud 92 surrounding printheads 20 and covering the underlying parts. Printing fluid flows to each printhead 20 through corresponding slots in bottom plate 90. In the example shown, four groups of slots deliver four printing fluids to each printhead 20. Printing fluids enter flow structure 84 at the upstream part of top plate 86 and pass through a network of ports, channels and slots in plates 86, 88 and 90 to printheads 20 at the downstream part of bottom plate 90.

Figure 11:
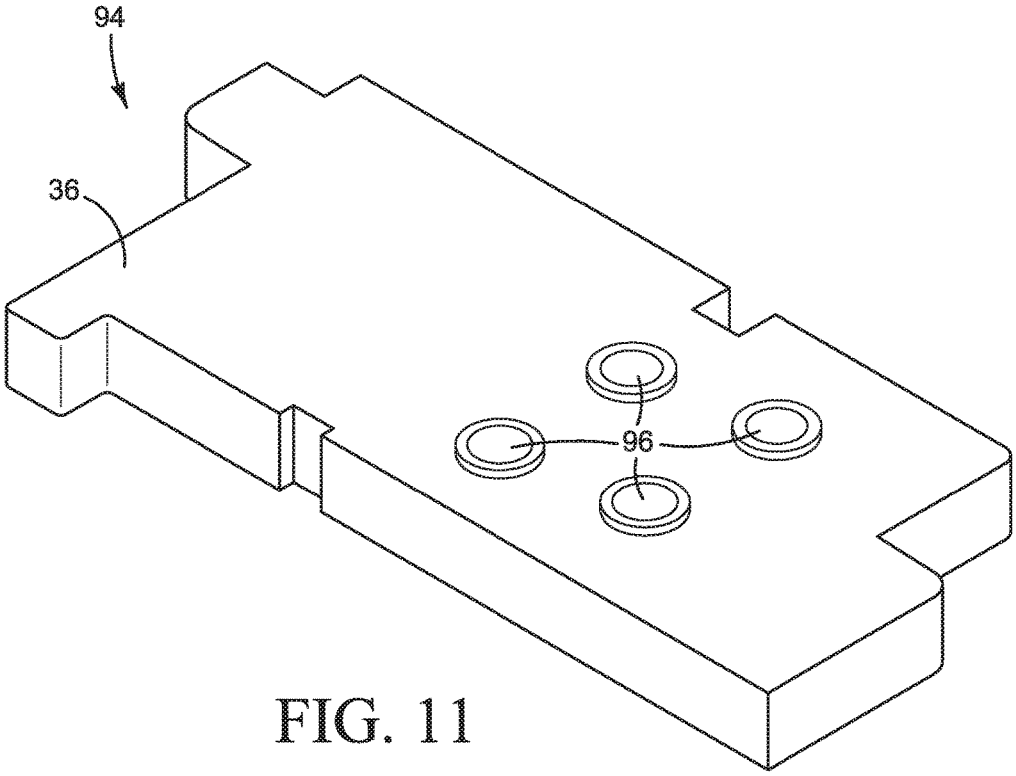
Figure 12:
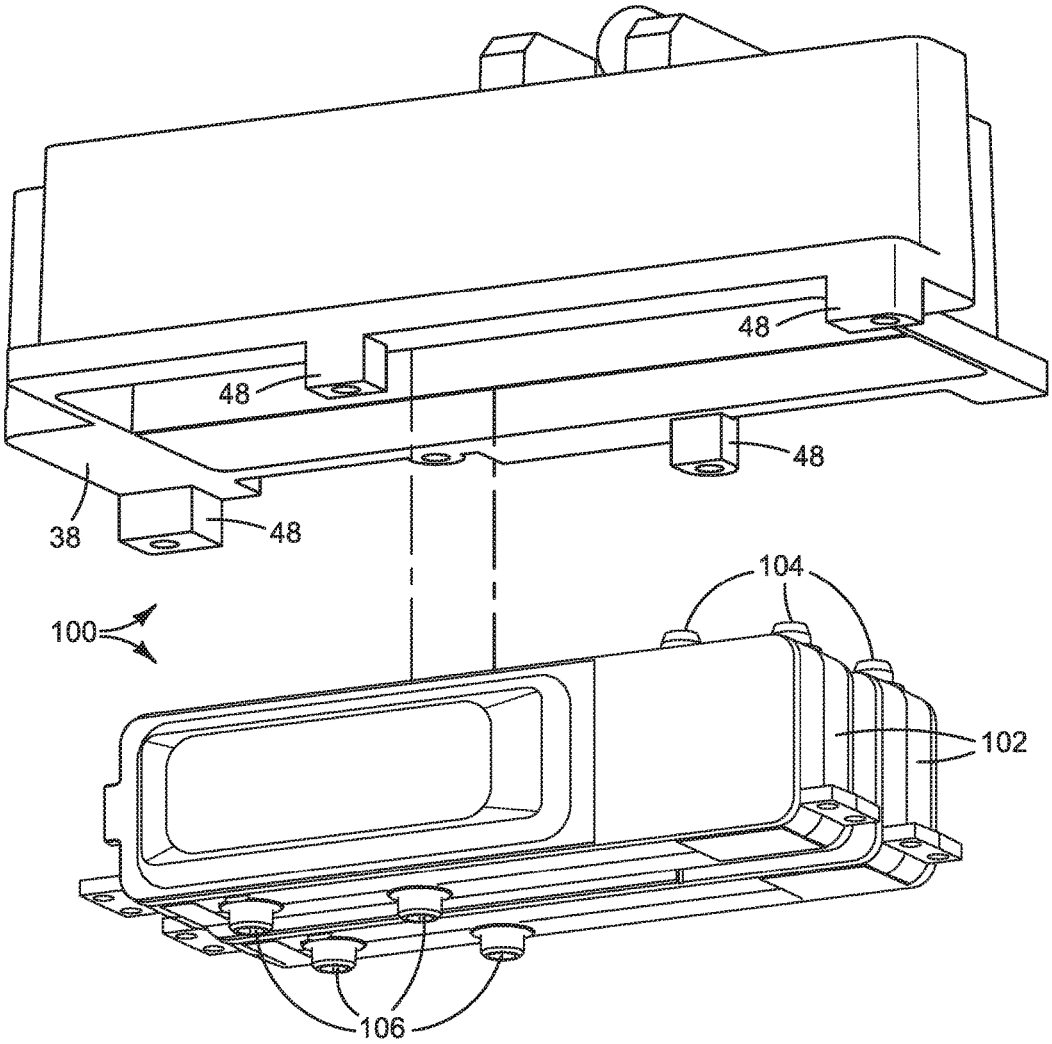
FIG. 12 illustrates one example of an upper subassembly in the printhead assembly of FIGS. 2-4.
Figure 13:
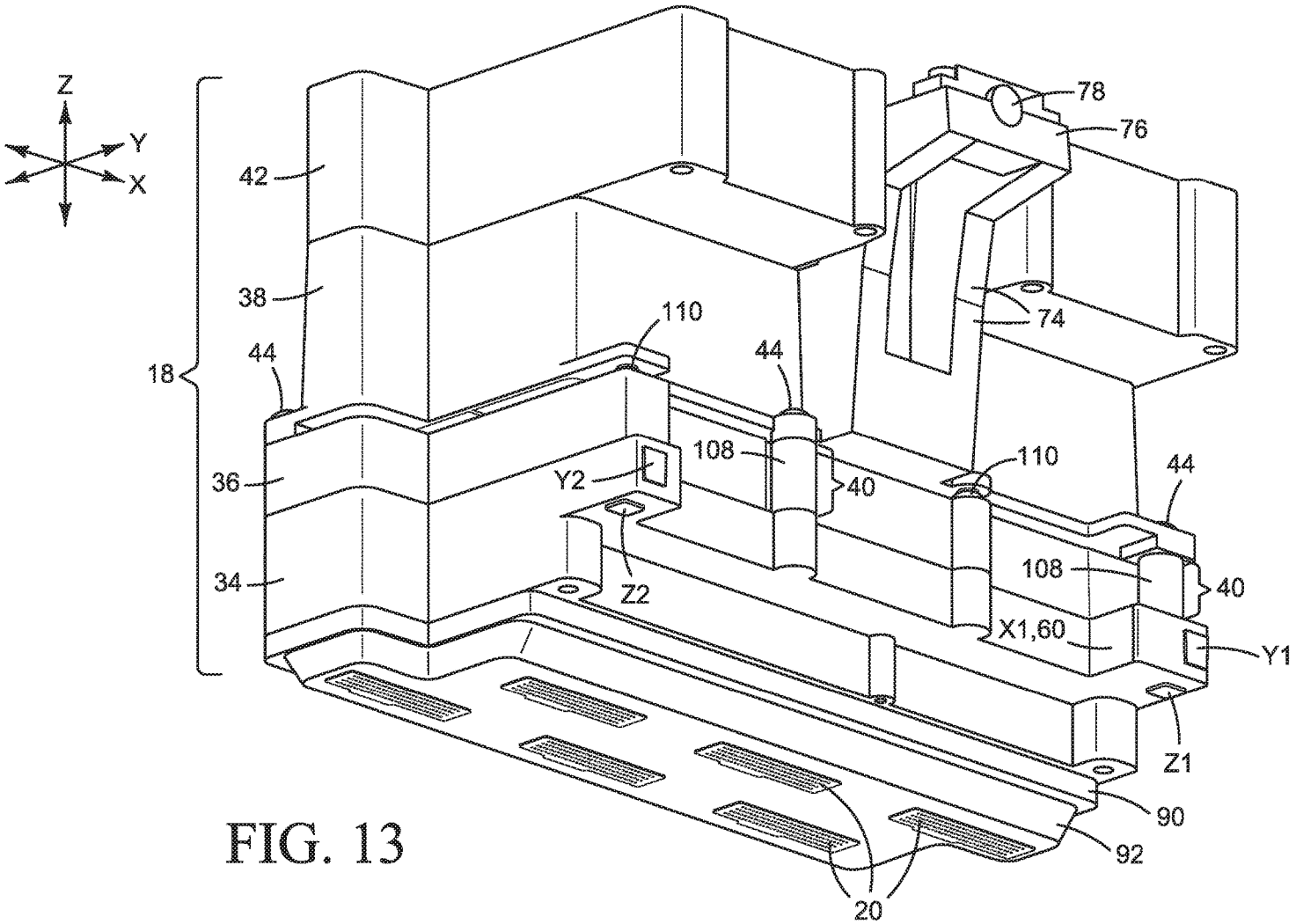
FIGS. 13-14 and 15-16 illustrate another example of a printhead assembly such as might be used in the printer shown in FIG. 1.
Figure 14:
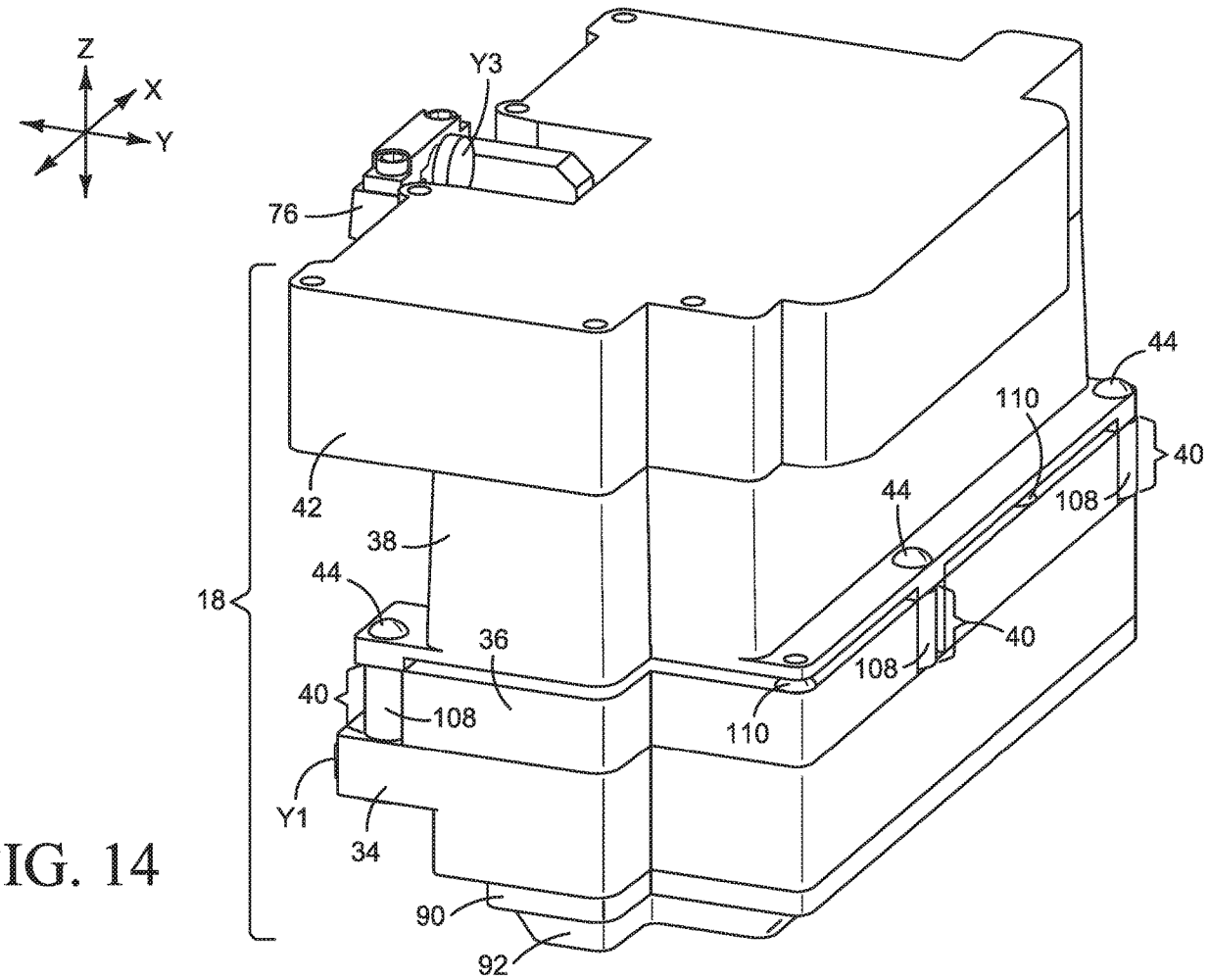
Figure 15:
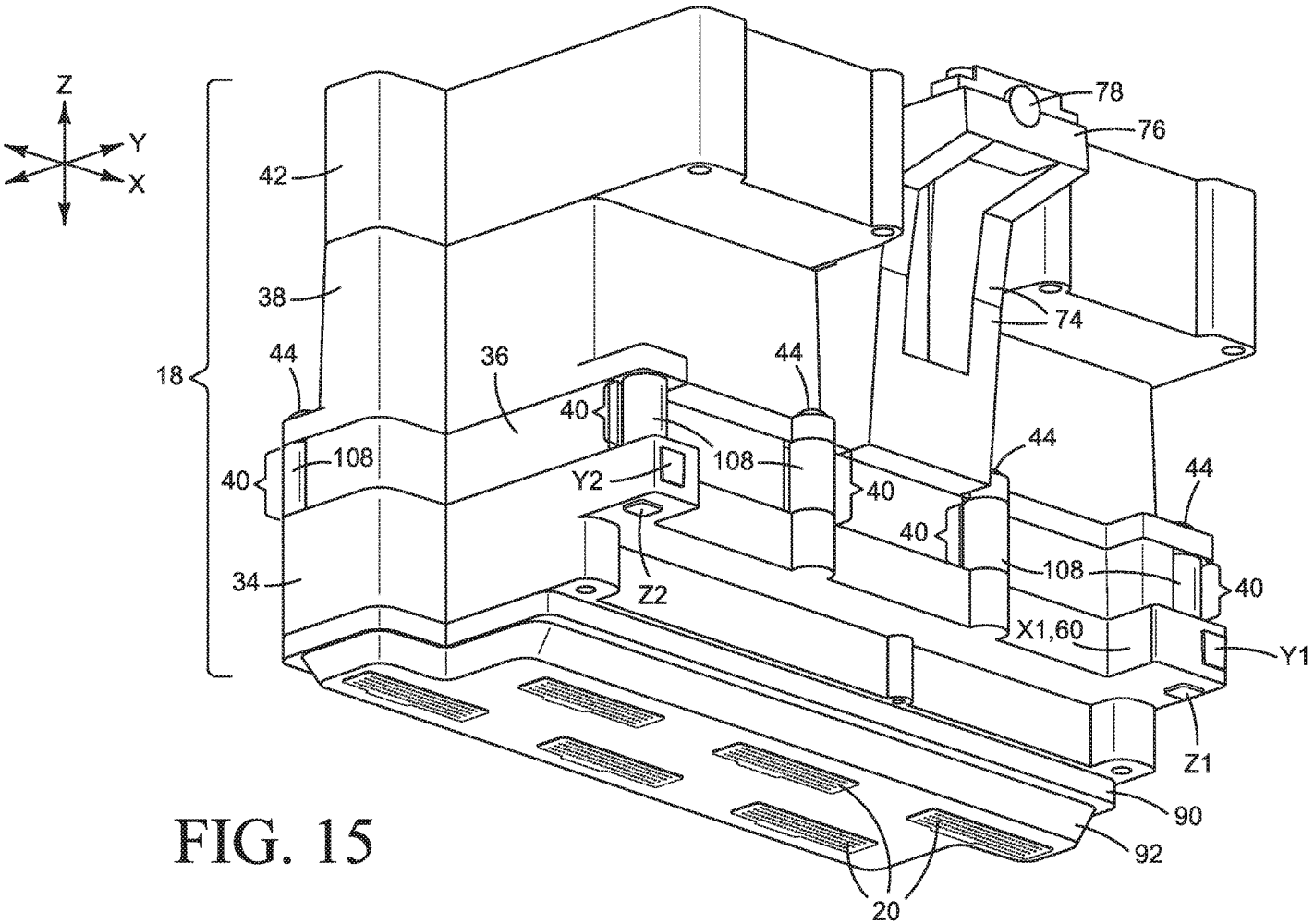
Figure 16:
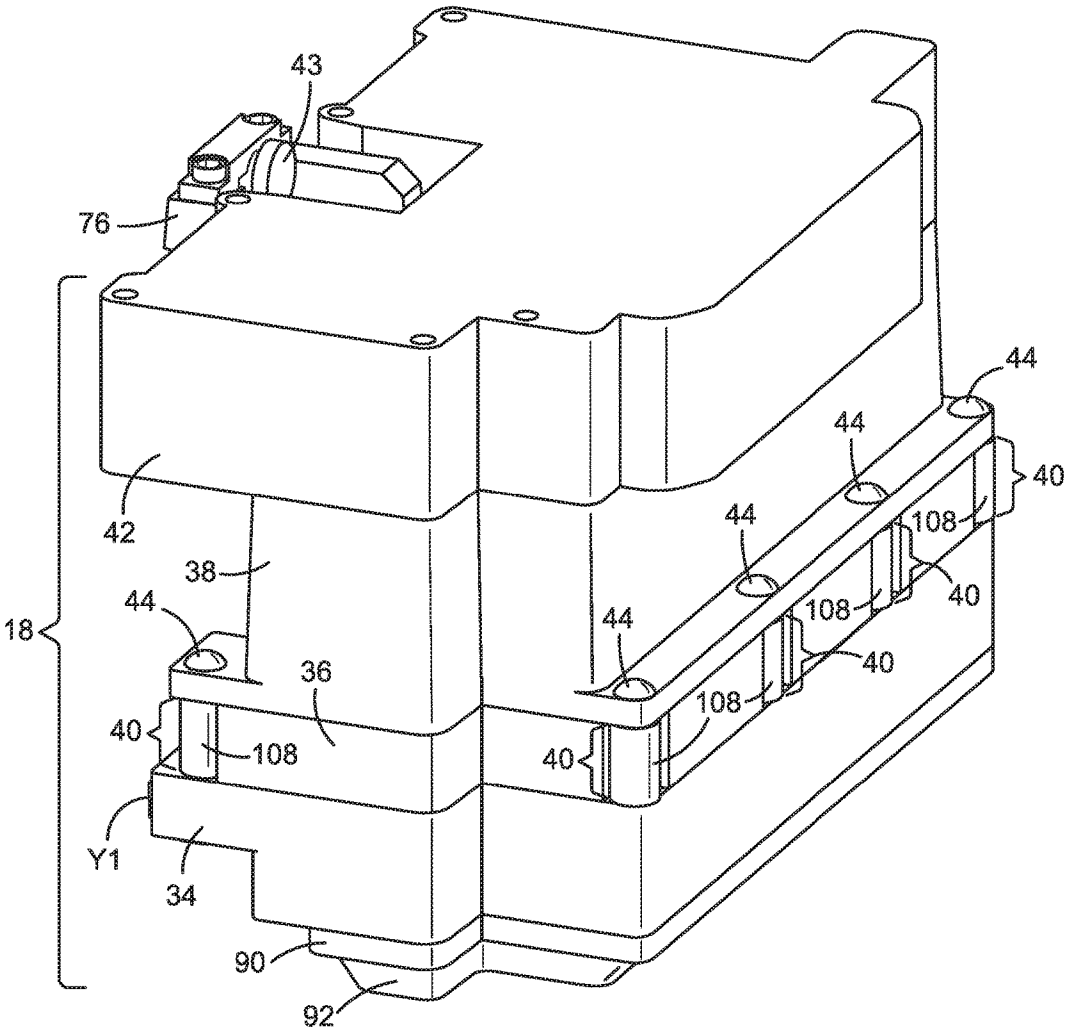

FIGS. 11 and 12 illustrate one example of a middle subassembly 94 in printhead assembly 12. Referring to FIGS. 11 and 12, middle subassembly 94 includes inlets 96 to manifold 36 and outlets 98 from manifold 36. In the example shown, four printing fluids (e.g., cyan, magenta, yellow and black ink) are received at a set of four inlets 96 and distributed to an array of twelve outlets 98 corresponding to twelve inlets (not shown) at lower structure top plate 86. Inlets 96 and outlets 98 may be integral to manifold 36 as shown or they may be formed in gaskets or other discrete parts assembled to manifold body part 36. In addition, it is expected that gaskets usually will be used to seal the fluid flow connections between manifold 36 and bodies 34, 38 whether or not the inlets 96 and outlets 98 are integral to the manifold itself. Gasketed fluid flow connections have the added benefit of reducing some of the stresses that could disturb body-to-body joints 40.

FIG. 12 is an exploded view illustrating one example of an upper subassembly 100 in printhead assembly 12. Referring to FIG. 12, upper subassembly 100 includes flow regulators 102 housed in upper body 38 to regulate the flow of printing fluid to printheads 20. Each flow regulator 102 includes inlets 104 to receive printing fluids from supplies 24 (FIG. 1) and outlets 106 to deliver printing fluids to middle subassembly 94.

FIGS. 13-14 and 15-16 illustrate other examples for joining bodies 34 and 38 in printhead assembly 12. In the example shown in FIGS. 13 and 14, discrete spacers 108 span manifold 36 at joints 40 at the same locations as bosses 46, 48 in FIGS. 2-4. Also, in this example, manifold 36 is fastened directly to lower body 34 with screws or other suitable fasteners 110 at four locations staggered across the front and back sides of bodies 34, 38 alternating between joints 40. In the example shown in FIGS. 15 and 16, spacers 108 are also used to span manifold 36 at joints 40 but at all eight fastener locations. Accordingly, in this example, manifold 36 is clamped between lower body 34 and upper body 38 rather than being positively fastened to lower body 34 as in FIGS. 13 and 14. While it is expected that lower body 34 and upper body 38 will usually be joined together directly, for example as shown in FIGS. 2-4, it may be desirable in some implementations to join the body parts indirectly, for example with spacers 108 as shown in FIGS. 13-16.

Datuming is described above with reference to X, Y and Z axes in a three dimensional Cartesian coordinate system, where the X axis extends in a direction laterally across the printhead assembly (which is laterally across a print zone perpendicular to the direction the print substrate moves through the print zone when the printhead assembly is installed in a printer), the Y axis extends in a direction along the printhead assembly (which is the same direction the print substrate moves through the print zone when the printhead assembly is installed in the printer), and the Z axis is perpendicular to the X and Y axes. In the examples shown, the X and Y axes extend horizontally and the Z axis extends vertically. This is just one example orientation for the X, Y, and Z axes. While this orientation for the X, Y, and Z axes may be common for many inkjet printing applications, other orientations for the X, Y, and Z axes are possible.

"A" and "an" used in the Claims means one or more.

As noted above, the examples shown in the Figures and described above do not limit the scope of the claimed subject matter, which is defined in the following Claims.

What is claimed is:

1. A printhead assembly, comprising:
- a plurality of printheads; and
- a printing fluid flow structure, comprising:
  - an upper body part comprising a number of flow regulators to regulate the flow of printing fluid through the printing fluid flow structure;
  - a lower body part comprising a number of printing fluid passages to carry the printing fluid to the plurality of printheads;
  - a manifold placed between the upper body and lower body to carry the printing fluid from the upper body part to the lower body part; and
- a number of spacers through each of which a fastener directly couples the upper body part to the lower body part clamping the manifold between the upper body part and the lower body part without a fastener passing through the manifold.

2. The printhead assembly of claim 1, wherein the plurality of printheads are staggered along a longitudinal axis of the lower body part.

3. The printhead assembly of claim 1, wherein the lower body part comprises:
- a top plate and a middle plate housed inside the lower body; and a bottom plate, the plurality of printheads, and a shroud downstream of the lower body part.

4. The printhead assembly of claim 2, wherein the top plate and middle plate comprise a flow structure comprising a number of ports, channels, and slots that deliver one of a plurality of different types of printing fluid to one of a plurality of nozzles defined in each of the plurality of printheads.

5. The printhead assembly of claim 2, wherein the shroud comprises a number of holes defined therein through which the printheads may be exposed.

6. The printhead assembly of claim 1, further comprising a number of spacers through each of which a fastener directly couples the upper body part to the lower body part.

7. The printhead assembly of claim 6, further comprising a number of manifold fasteners that couple the manifold directly to the lower body part.

8. The printhead assembly of claim 7, wherein the number of spacers is four and the number of manifold fasteners is four with spacers and manifold fasteners alternating across a front and back side of the printhead assembly.

9. A fluid dispenser, comprising:

a first body part;

a second body part;

a third body part placed between the first and second body part; and a number of spacers through each of which a fastener directly couples the first body part to the second body part clamping the third body part between the first body part and the second body part without a fastener passing through the manifold;

wherein the first, second, and third body part form a fluid path that a fluid may flow to a plurality of staggered and longitudinally overlapping printheads.

10. The fluid dispenser of claim 9, wherein:

the first body part comprises a fluid regulator;

the second body part comprises a top plate and a middle plate housed inside the second body and a bottom plate downstream of the second body part;

the third body part comprises a manifold to direct the fluid from the first body part to the second body part.

11. The fluid dispenser of claim 9, wherein the plurality of staggered and longitudinally overlapping printheads are staggered and longitudinally overlapping with respect to a longitudinal axis of the second body part.

12. A printhead assembly, comprising:

a plurality of printheads; and a printing fluid flow structure, comprising:

an upper body part comprising a number of flow regulators to regulate the flow of printing fluid through the printing fluid flow structure;

a lower body part comprising a number of printing fluid passages to carry the printing fluid to the plurality of printheads; and a manifold placed between the upper body and lower body to carry the printing fluid from the upper body part to the lower body part;

wherein the plurality of printheads are staggered along a longitudinal axis of the lower body part; and wherein the lower body part comprises:

a top plate and a middle plate housed inside the lower body;

a bottom plate, the plurality of printheads, and a shroud downstream of the lower body part; and a number of spacers through each of which a fastener directly couples the upper body part to the lower body part and a number of manifold fasteners that couple the manifold directly to the lower body part, wherein the number of manifold fasteners at least partially occupy a space formed between the manifold and the upper body part.

13. The printhead assembly of claim 12, wherein the number of spacers is four and the number of manifold fasteners is four with spacers and manifold fasteners alternating across a front and back side of the printhead assembly.

* * * * *